United States Patent [19]

Lucas et al.

[11] Patent Number: 4,840,003

[45] Date of Patent: Jun. 20, 1989

[54] CONSTRUCTION LOG AND ASSOCIATED CORNER CONSTRUCTION

[75] Inventors: Gordon H. Lucas; Randy K. Giles, both of Jefferson County, Tenn.

[73] Assignee: Hearthstone Builders, Inc., Dandridge, Tenn.

[21] Appl. No.: 118,554

[22] Filed: Nov. 9, 1987

[51] Int. Cl.[4] ..... E04B 1/10

[52] U.S. Cl. ..... 52/233; 52/286; 405/284

[58] Field of Search ..... 52/233, 286, 284; 405/273, 284, 285

[56] References Cited

U.S. PATENT DOCUMENTS

| | | | |
|---|---|---|---|
| 1,996,735 | 4/1935 | King | 52/233 |
| 2,110,787 | 3/1938 | Brandjord | 52/233 |
| 2,712,678 | 7/1955 | Jensen | 52/233 |
| 3,189,950 | 6/1965 | Johnson | 52/233 |
| 3,381,428 | 5/1968 | Sillman | 52/233 |
| 3,552,079 | 1/1971 | Mortensen | 52/233 |
| 4,034,527 | 7/1977 | Jalasjaa | 52/233 |
| 4,185,428 | 1/1980 | Boucquey et al. | 52/233 |
| 4,219,977 | 9/1980 | Bene et al. | 52/233 |
| 4,277,925 | 7/1981 | Kinser | 52/233 |
| 4,279,108 | 7/1981 | Collister, Jr. | 52/233 |
| 4,287,694 | 9/1981 | Cornell | 52/233 |
| 4,330,973 | 5/9182 | Marklund et al. | 52/233 |
| 4,353,191 | 10/1982 | Schilbe | 52/233 |
| 4,429,500 | 2/1984 | Farmont | 52/233 |
| 4,599,837 | 7/1986 | Wrightman | 52/233 |
| 4,688,362 | 8/1987 | Pedersen et al. | 52/233 X |

FOREIGN PATENT DOCUMENTS

| | | | |
|---|---|---|---|
| 1452263 | 9/1966 | France | 52/233 |
| 1517692 | 3/1968 | France | 52/233 |
| 76613 | 4/1950 | Norway | 52/233 |
| 270008 | 11/1950 | Switzerland | 52/233 |
| 686663 | 1/1953 | United Kingdom | 52/233 |
| 790977 | 2/1958 | United Kingdom | 52/233 |

*Primary Examiner*—Michael Safavi

*Attorney, Agent, or Firm*—Pitts and Brittian

[57] ABSTRACT

An improved log (10) for interlocking with similar logs in the construction of a log structure and associated corner joint construction. The improved log (10) comprises an elongated body (14) defining an upper portion (16) and a lower portion (18), and first and second exterior surfaces (20 and 22). The log (10) has at least a first end portion (24) for interlocking with similar logs to form a corner joint, the first end portion (24) being provided with an upper notch (28) and a lower notch (30). The upper notch (28) defines at least a first engaging surface (32) for engaging a similar log (10), and a second vertically oriented engaging surface (34) provided with a vertically disposed first tenon. The lower notch (30) defines at least a third engaging surface (38) for engaging the first engaging surface (32) of a smilar log (10), and a vertically oriented fourth engaging surface (40) provided with a vertically disposed second tenon (42). The first end portion (24) is also provided with a vertically disposed mortise (44) for receiving the first and second tenons (36 and 42) of other similar logs (10) to allow the logs to be interlocked to form a corner joint. The corner joint construction of the present invention also contemplates the interposing of interfacing beams (12) between the logs (10), the beams (12) having at least one outboard end (50) provided with a tenon (52) for being received in the mortise of the intersecting log (10) of an adjoining wall.

15 Claims, 4 Drawing Sheets

CONSTRUCTION LOG AND ASSOCIATED CORNER CONSTRUCTION

TECHNICAL FIELD

This invention relates to an improved log for the construction of log structures and an associated corner construction for log structures. In this particular invention, the log has at least one end portion with an upper and lower notch, each such notch further incorporating a tenon, and is provided with a mortise for receiving the tenons of intersecting logs.

BACKGROUND ART

In the construction of log structures, the logs of adjoining walls are generally interlocked to form corner joints. To accomplish this, the ends of the logs are notched to receive the end portions of logs of an intersecting wall, with intersecting logs being alternately stacked such that adjoining walls interlock. Whereas this interlocking of logs initially produces a strong corner joint where the notches have been cut to closely receive intersecting logs, there is a tendency for logs to shrink radially as they age and dry out. As a result, the notches no longer securely engage the intersecting logs, and the corner loses its original strength and stability. In an attempt to overcome this problem, metal spikes or rods are often driven through the log ends at the point where they intersect to reinforce the corner joint. Whereas this does serve to reinforce the corner joint, the logs still tend to shrink away from associated notch surfaces, destabilizing the joint. Other attempts have been made to devise improved log structures, some of which are exemplified by U.S. Pat. Nos: 1,996,735; 2,110,787; 2,712,678; 3,381,428; 3,552,079; 4,219,977; 4,287,694; 4,330,973; 4,353,191; 4,429,500; 4,599,837; 4,185,428; and 4,277,925. It will be noted that in many cases, such attempts to improve strength and ease of construction have resulted in a loss of the appearance of a traditional log structure.

Therefore, it is an object of the present invention to provide an improved log and associated corner construction for constructing log structures.

It is a further object of the present invention to provide an improved log for constructing log structures which interlocks with similar logs to produce strong, stable corner joints.

Yet another object of the present invention is to provide an improved corner joint for a log structure which remains strong and stable, notwithstanding shrinkage of the logs as they age.

A further object of the present invention is to provide an improved log and corner joint for the construction of structures having the appearance of a traditional log home.

It is another object of the present invention to provide an improved log for constructing log structures which is inexpensive to manufacture.

DISCLOSURE OF THE INVENTION

Other objects and advantages will be accomplished by the present invention which provides an improved log for interlocking with similar logs in a log structure and an improved corner construction. The log of the present invention comprises an elongated body defining an upper portion and a lower portion, and first and second exterior surfaces. The log has at least one end portion configured for interlocking with similar logs to form a corner joint, this end portion being provided with an upper notch in the upper portion of the log body and a lower notch in the lower portion of the log body. The upper notch defines at least a first engaging surface for engaging and supporting a similar log, and a second vertically oriented engaging surface provided with a vertically disposed first tenon. The lower notch defines at least a third engaging surface for engaging the first engaging surface of a similar log, and a substantially vertically oriented fourth engaging surface provided with a vertically disposed second tenon. The end portion of the log also is provided with a vertically disposed mortise defined in the second exterior surface of the log body for receiving the first and second tenons of the end portions of other similar logs to allow the logs to interlock to form a corner joint. The corner construction of the present invention also contemplates the interposing of interfacing beams between the logs of a common wall, the interfacing beams having at least one outboard end portion provided with a tenon for being received in the mortise of the intersecting log of an adjoining wall.

BRIEF DESCRIPTION OF THE DRAWINGS

The above-mentioned features of the present invention will become more clearly understood from the following detailed description of the invention read together with the drawings in which.

BEST MODE FOR CARRYING OUT THE INVENTION

Figure 1:
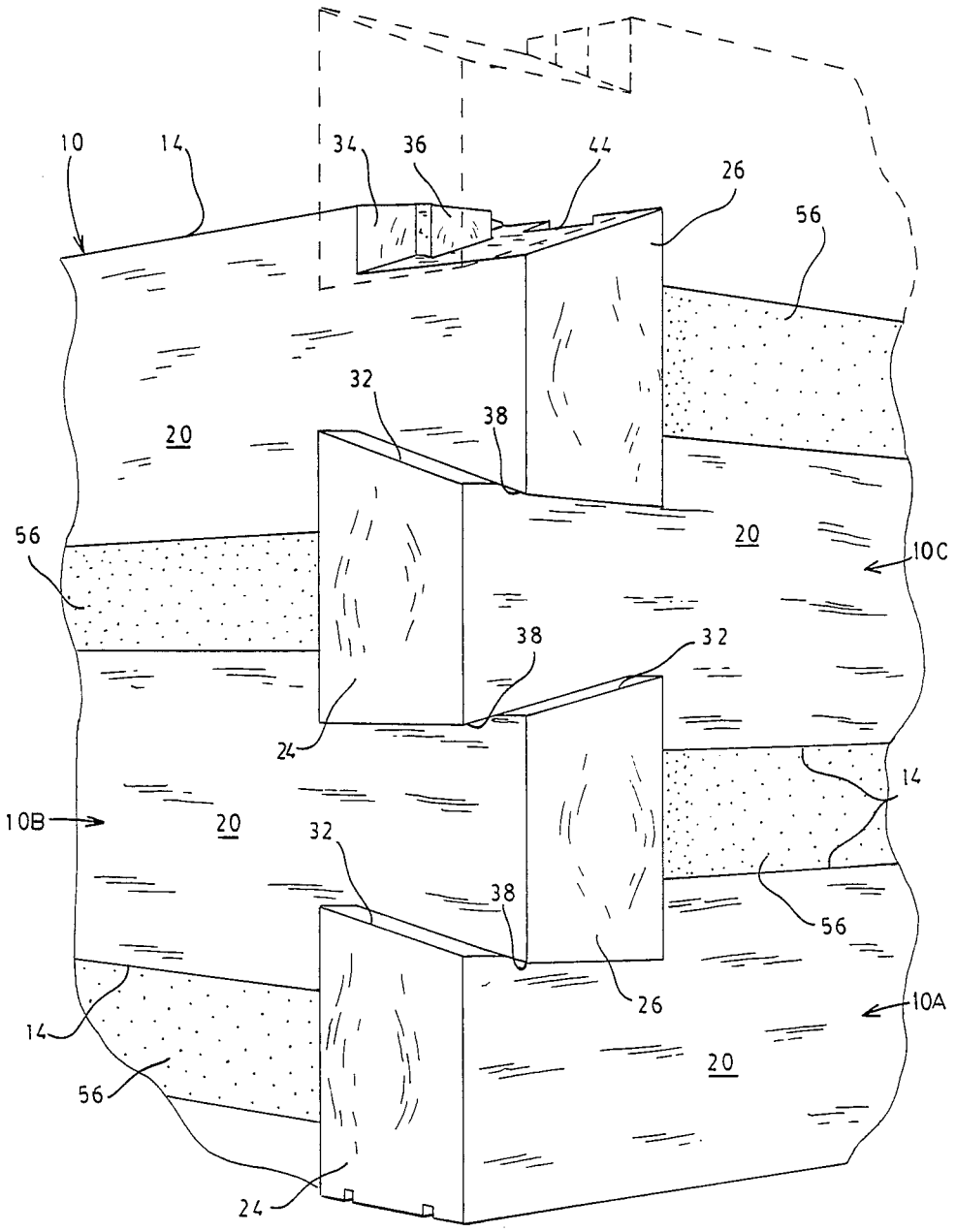
FIG. 1 illustrates a perspective view of a portion of a log structure embodying the corner construction and improved logs of the present invention.

A corner joint of a log structure built in accordance with the present invention is illustrated in FIG. 1, and a log incorporating various features of the improved log of the present invention is illustrated generally at 10 in the figures. The logs 10 are used in the construction of log structures such as homes, barns and commercial buildings, and as will be discussed in detail below, in the preferred embodiment the logs 10 are used in conjunction with interfacing beams/blocks 12 (see FIGS. 7 and 8) to construct such log structures. In this regard, a plurality of the logs 10 are stacked with a beam 12 interposed between the logs 10, and with the logs of intersecting walls interlocking to produce strong durable corner joints.

Each of the logs 10 comprises an elongated body 14 having upper and lower portions 16 and 18, respectively, and first and second exterior surfaces 20 and 22, respectively. Further, each of the logs 10 has first and second opposite end portions 24,26 with at least one end portion being configured to interlock with other logs 10. In this regard, it will be understood by those skilled in the art that where the log 10 extends the length of the wall into which it is incorporated, both end portions will be configured to engage intersecting logs 10 from adjoining walls; but where the log 10 extends only a portion of the length of the wall, only one of the end portions will be configured for incorporation into a corner joint. However, for the purpose of illustration, the logs 10 of the figures are depicted as having the first and second opposite end portions 24 and 26, respectively, both of which are configured for engaging intersecting logs 10 at the corner of a log structure.

As best illustrated in FIGS. 2 through 5, each of the end portions 24 and 26 is provided with an upper notch 28 and a lower notch 30. The upper notch 28 defines a first engaging surface 32 for engaging and supporting the opposite end portion 24 and 26 of an intersecting log 10. In the preferred embodiment, the engaging surface 32 defines a planar surface which is laterally inclined from a point at, or proximate, the first exterior surface 20, to a point at, or proximate, the second exterior surface 22 so as to define a first angle 33 from horizontal. (See FIG. 3) The upper notch 28 also defines a second engaging surface 34 which is substantially vertically oriented so as to be aligned to abut a portion of the second surface 22 of an intersecting log 10. Further, an operatively associated vertically aligned tenon 36 protrudes from the second engaging surface 34 which, as will be discussed below, serves to engage an intersecting log 10. It will be noted that in the preferred illustrated embodiment, the tenon 36 comprises a dovetail tenon, but other tenon configurations can be utilized if desired.

It will be noted that the tenon 36 need not be integral with the log 10. As illustrated by the broken lines in FIG. 6, the tenon 36 can comprise the outboard portion of a spline member 37 having a first end portion 41 which is slidably received in a corresponding groove 43 in the second engaging surface 34. While a dovetailed spline configuration is shown, it will be recognized by those skilled in the art that the spline could assume various cross-sectional geometrics, such as a figure "8".

Figure 2:
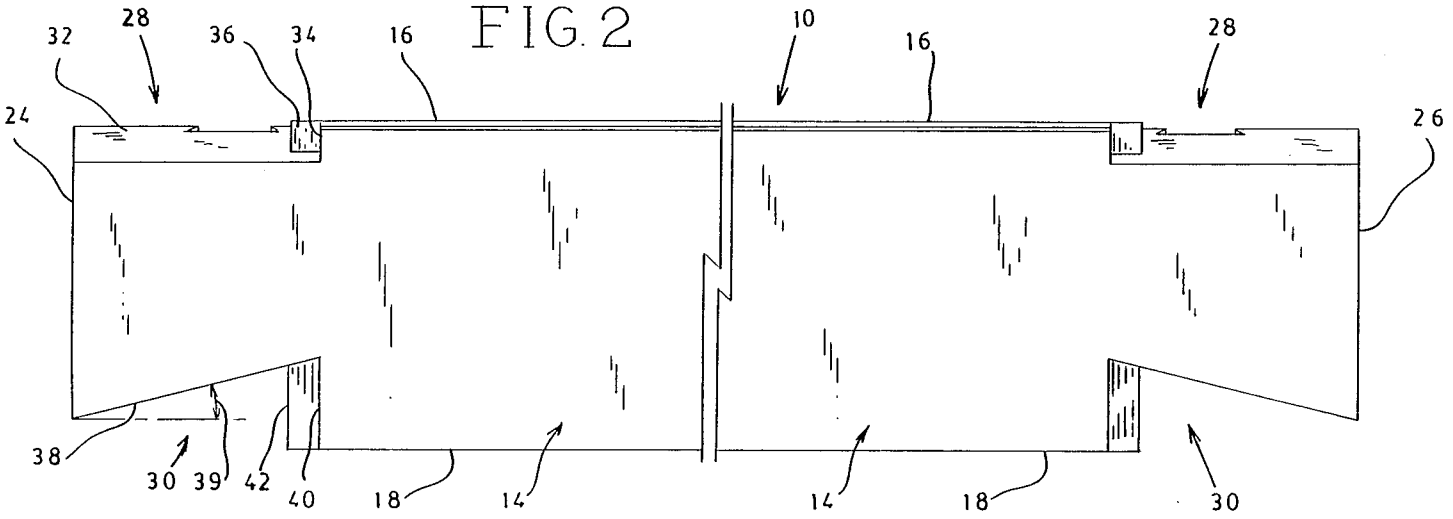
FIG. 2 illustrates a front view of an improved log of the present invention.
Figure 4:
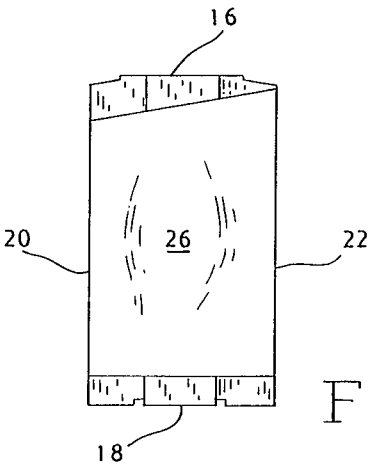
FIG. 4 illustrates a right side elevation of an improved log of the present invention.
Figure 3:
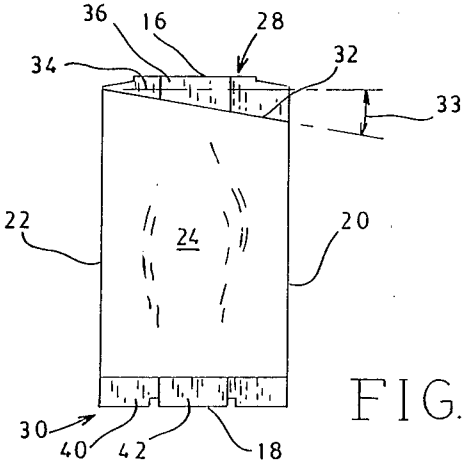
FIG. 3 illustrates a left side elevation of an improved log of the present invention.

The lower notch 30 is configured to engage the upper notch 28 of an intersecting log 10 at the corner of a log structure. Accordingly, the lower notch 30 defines a third engaging surface 38 and a fourth engaging surface 40. The third engaging surface 38 defines a planar surface which is longitudinally inclined from a point at, or proximate, the outboard end of the log body 14 to a point displaced a selected distance from the outboard end portion where the surface 38 intersects the surface 40. It will be understood that the third engaging surface 38 is oriented to engage the first engaging surface 32 of an intersecting log 10. Thus, the angle of incline of the third engaging surface 38, illustrated at 39 in FIG. 2, is preferably equal to the angle of incline 33 of the first engaging surface 32 such that intersecting logs 10 closely interlock. The fourth engaging surface 40 is substantially vertically oriented, preferably on a common plane with the surface 34 of the upper notch 28. A further tenon 42, operatively associated with, and protruding from, the fourth surface 40 is provided for engaging an intersecting log 10 as discussed below, the further tenon 42 preferably sharing a common vertical alignment with the tenon 36.

As with the tenon 36, the further tenon 42 comprises a dovetail tenon, but other tenon configurations can be utilized. Also, the tenon 42 need not be integral with the log 10. As described above with respect to the tenon 36, the tenon 42 can comprise a portion of a second spline member which is releasably received in a corresponding second groove in the fourth engaging surface 40.

Figure 5:
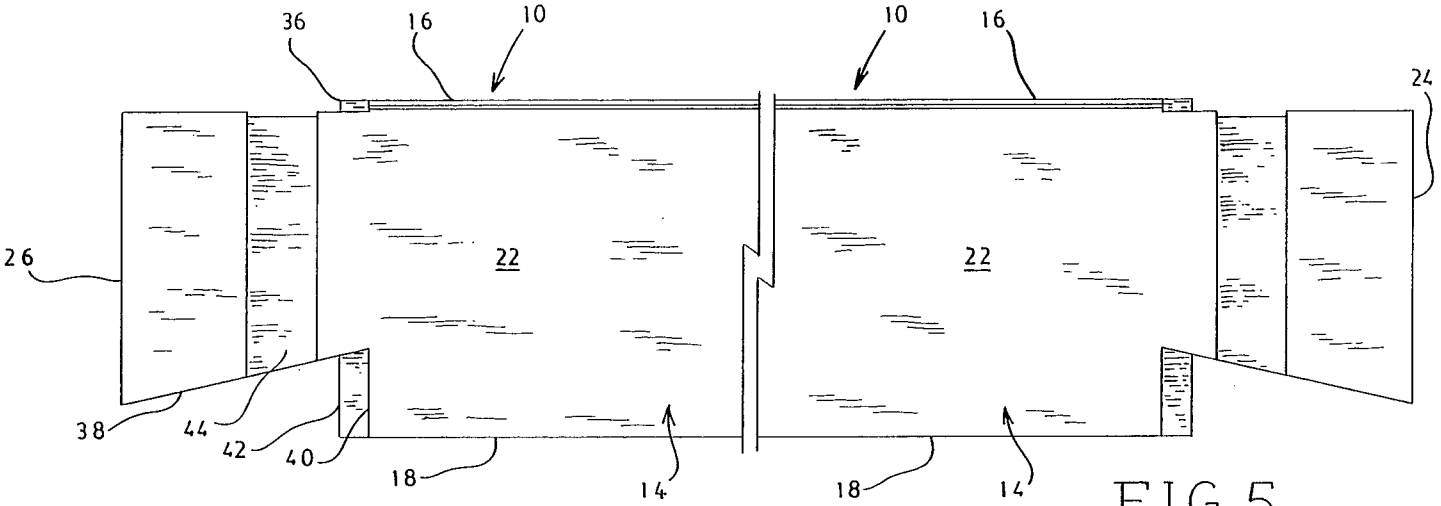
FIG. 5 illustrates a rear view of an improved log of the present invention.
Figure 6:
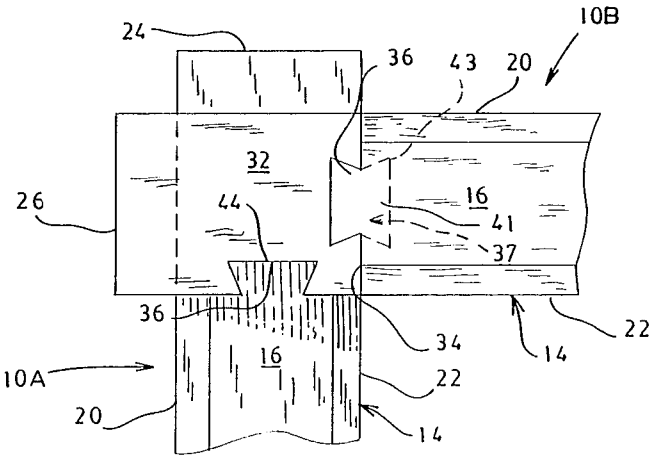
FIG. 6 illustrates a top view of a corner joint of the present invention.

As best illustrated in FIG. 5, each of the end portions 24 and 26 of the log body 14 is provided with a vertically disposed mortise 44 which registers with, and closely receives, the tenons 36 and 42 of intersecting logs 10. (See FIG. 6) Thus, as illustrated in FIGS. 1 and 6, as the logs 10A and B of the present invention intersect to form a corner joint, the mortise 44 of the log 10A slidably receives the tenon 42 of the log 10B, and the mortise 44 of log 10B slidably receives the tenon 36 of the log 10A, thereby locking the logs 10A and B together with the first end portion 24 of the log 10A supporting the second end portion 26 of the log 10B. Similarly, the mortise 44 of the log 10B slidably receives the tenon 42 of the log 10C, and the mortise 44 of the log 10C slidably receives the tenon 36 of the log 10B, thereby locking the logs 10B and 10C together. Of course, by thusly interlocking a selected number of intersecting logs 10, strong durable corner joints can be constructed. In this regard, each log 10 is axially locked into the corner joint by its tenons 36 and 42, and is locked with respect to the axis of intersecting logs 10 by receiving the tenons of such other logs in its mortise 44. Resultantly, the relative axial alignment of intersecting logs is fixed, and even if there is radial shrinkage of the logs, the tenons remain locked in their associated mortises, and stability and proper alignment of the corner joint is maintained.

Figure 8:
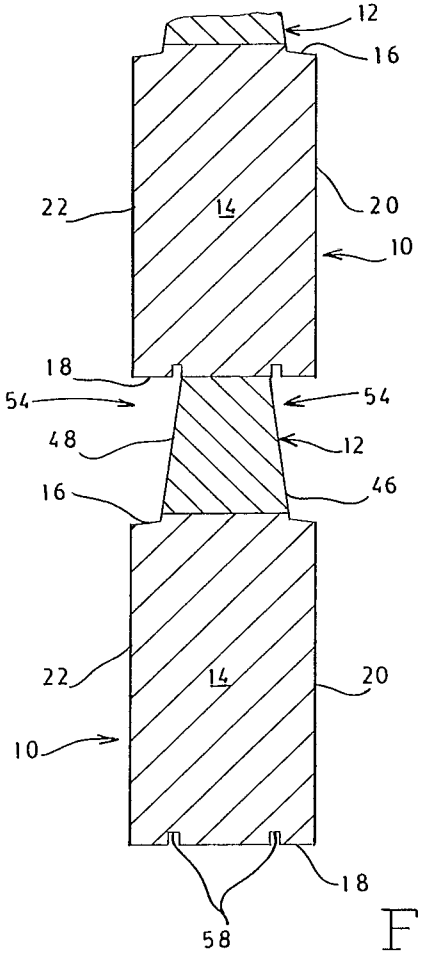
FIG. 8 illustrates a partial side elevation, in section, of a wall embodying the building construction of the present invention.
Figure 7:
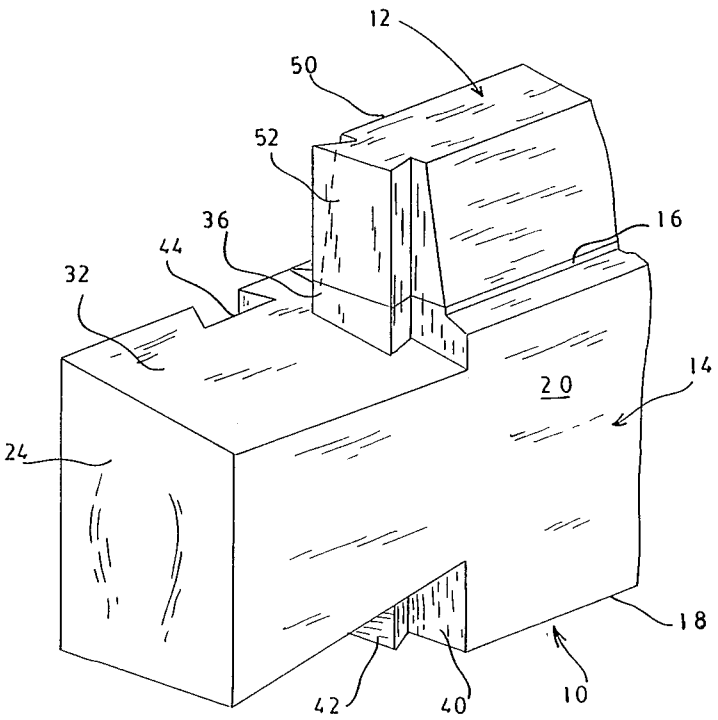
FIG. 7 illustrates a perspective view of a portion of an improved log and interfacing beam in accordance with the building construction of the present invention.

As indicated above, the building construction of the present invention also contemplates the use of the interfacing beams/blocks 12 which are positioned between the logs 10 of a log structure, as illustrated in FIGS. 7 and 8, thereby filling the space between logs 10 of a wall of the log structure. Whereas it may be desirable that the interfacing beams 12 be continuous with the wall of the associated log structure, the beams 12 need not be continuous with the wall and can comprise short beam sections disposed at corner joints and at selected intervals along each wall if desired. The beams 12 have opposite side portions 46 and 48, and have at least one outboard end 50 for engaging an intersecting log 10 at a corner joint. In this regard, the outboard end 50 of the beam 12 carries a vertically disposed tenon 52 which is slidably received in the mortise 44 of an intersecting log 10 so as to lock the beam 12 and such intersecting log together.

It will be noted that the beam 12 defines a lesser width than the logs 10, such that when the beam is in position between the logs 10 of a wall, the indentations 54 are defined, as best illustrated in FIG. 8. These indentations 54 are filled with mortar 56, or other sealant, as illustrated in FIG. 1 in order to seal the wall and to give the wall the look of a traditional log structure. Further, if desired, the lower portion 18 of the logs 10 can be provided with the longitudinal grooves 58 which run adjacent to the sidewalls 46 and 48 of the beam 12 positioned below. These grooves 58 serve to receive prefabricated panels (not shown) which are secured to the sidewalls 46 and 48, and simulate or give the appearance of mortar. It will also be noted that the logs 10 can be manufactured such that each log integrally defines an interfacing beam 12 or non-continuous beam sections, if desired.

In light of the above, it will be appreciated that the present invention provides an improved construction log and corner construction for log structures with clear advantages over the prior art. The logs 10 allow corners to be constructed which remain strong and stable notwithstanding log shrinkage. Moreover, the mortises and tenons of the logs 10 lock each pair of intersecting logs in proper perpendicular alignment and insure the continuation of such alignment. Further, in conventional log structures, log shrinkage at the corner joints creates gaps which allow air and moisture to pass into and out of the structure. However, the mortises and tenons of the logs 10 maintain an air and moisture seal at the corner joints even after log shrinkage. And, such advantages are accomplished without the resulting structure losing the appearance of a traditional log structure.

While a preferred embodiment has been shown and described, it will be understood that there is no intent to limit the invention to such disclosure, but rather it is intended to cover all modifications and alternate constructions falling within the spirit and scope of the invention as defined in the appended claims.

We claim:

1. An improved log for interlocking with other similar logs for the construction of a log structure, said improved log comprising an elongated body defining a longitudinal axis and having an upper portion and a lower portion, and first and second exterior surfaces, said body including at least a first end portion for interlocking with said other similar logs, said first end portion defining a distal end and being provided with:

an upper notch provided in said upper portion of said body for engaging said similar log, said upper notch having a first engaging surface and a second substantially vertical engaging surface, said first engaging surface defining a planar surface which is laterally inclined from a point proximate said first exterior surface of said body to a point proximate said second exterior surface of said body, said second engaging surface provided with a first dovetail tenon;

a lower notch provided in said lower portion of said body for engaging said similar log, said lower notch having a third engaging surface for engaging a first engaging surface of said similar log and a fourth substantially vertically disposed engaging surface provided with a second dovetail tenon, said third engaging surface defining a further planar surface which is longitudinally inclined from a point proximate said distal end of said body to a point displaced a selected distance from said distal end so as to closely receive said first engaging surface of said similar log; and a substantially vertically disposed dovetail mortise defined in said second exterior surface of said body for receiving said first and second tenons of said first end portion of said similar logs.

2. The improved log of claim 1 wherein said upper notch defines a first groove, and said log is provided with a first spline member having a first portion for being slidably received in said first groove and a second portion defining said first dovetail tenon.

3. The improved log of claim 1 wherein said lower notch defines a second groove and said log is provided with a second spline member having a first dovetail portion slidably received in said second groove and a second portion defining said second tenon.

4. An improved log for interlocking with other similar logs for construction of a log structure, said improved log comprising an elongated body defining a longitudinal axis and having an upper portion and a lower portion, and first and second exterior surfaces, said body having at least a first end portion, including a distal end, for interlocking with said other similar logs, said first end portion being provided with:

an upper notch provided in said upper portion of said body, said upper notch defining at least a first engaging surface for engaging and supporting said similar logs, and a second engaging surface, said first engaging surface defining a planar surface which is laterally inclined from a point proximate said first exterior surface of said body to a point proximate said second exterior surface of said body, said second engaging surface being substantially vertically oriented and provided with an operatively associated substantially vertically disposed first tenon;

a lower notch provided in said lower portion of said body, said lower notch defining at least a third engaging surface for being supported on said first engaging surface of said upper notch of said similar logs, and a substantially vertically oriented fourth engaging surface provided with an operatively associated substantially vertically disposed second tenon, said third engaging surface defining a further planar surface which is longitudinally inclined from said distal end of said body to a point displaced a selected distance from said distal end so as to closely receive a first engaging surface of said similar log; and a substantially vertically disposed mortise defined in said second exterior surface of said body for receiving said first and second tenons of said first end portions of said similar logs.

5. The improved log of claim 4 wherein said first and second tenons comprise dovetail tenons, and said mortise defines a dovetail mortise for closely receiving said first and second tenons.

6. The improved log of claim 4 wherein said second engaging surface of said upper notch defines a first groove, and said log is provided with a first spline member having a first portion for being slidably received in said first groove and a second portion defining said first tenon, and wherein said fourth engaging surface of said lower notch defines a second groove and said log is provided with a second spline member having a first portion slidably received in said second groove and a second portion defining said second tenon.

7. The improved log of claim 6 wherein said first and second tenons and said first portions of said first and second spline members define dovetail tenons and said mortise and said first and second grooves define dovetail configurations for closely receiving said first and second tenons and said first and second portions of said spline members.

8. In a log structure having at least first and second intersecting walls, a corner joint construction comprising:

a plurality of logs for constructing said first and second walls of said log structure, each said log comprising an elongated body defining a longitudinal axis and having an upper portion and a lower portion, and first and second exterior surfaces, said body having at least a first end portion for interlocking with other said logs, said first end portion further defining a distal end, said first end portion being provided with an upper notch defined in said upper portion of said body for engaging another said log, said upper notch defining an engaging surface having an operatively associated substantially vertically disposed first tenon, said first end portion being provided with a lower notch defined in said lower portion of said body for engaging another said log, said lower notch defining an engaging surface having an operatively associated substantially vertically disposed second tenon, said first end portion being further provided with a substantially vertically disposed mortise defined in said second exterior surface of said body for receiving said first and second tenons of said first end portions of other said logs; and a plurality of interfacing beams for interposing between said logs of said first wall and between said logs of said second wall of said log structure, each said beam having at least a first end provided with a tenon for being received in said mortise of said logs; and wherein said first end portions of said logs of said first and second walls are alternately interlocked with said interfacing beams disposed between said logs of said first wall and said logs of said second wall.

9. The corner joint construction of claim 8 wherein said first and second tenons of each said log comprise dovetail tenons and said tenon of each said interfacing beam comprises a dovetail tenon, and wherein said mortise of each said log defines a dovetail mortise for closely receiving said first and second tenons of said logs and said tenons of said interfacing beams.

10. The corner construction of claim 8 wherein said upper notch defines a first engaging surface and a second, substantially vertical, engaging surface, said second engaging surface being provided with said first tenon, and wherein said lower notch defines a third engaging surface, for engaging said first engaging surface of another said log, and a fourth, substantially vertical, engaging surface provided with said second tenon.

11. The corner construction of claim 10 wherein said first and second tenons of each said log comprise dovetail tenons and said tenon of each said interfacing beam comprises a dovetail tenon, and wherein said mortise of each said log defines a dovetail mortise for closely receiving said first and second tenons of said logs and said tenons of said interfacing beams.

12. The corner construction of claim 11 wherein said first engaging surface of said upper notch defines a planar surface which is laterally inclined from a point proximate said first exterior surface of said body to a point proximate said second exterior surface of said body, and said third engaging surface of said lower notch defines a further planar surface which is longitudinally inclined from a point proximate said distal end of said body to a point displaced a selected distance from said distal end so as to closely receive said first engaging surface of said upper notch.

13. The corner construction of claim 8 wherein said log integrally carries at least one said interfacing beam.

14. The corner construction of claim 8 wherein said upper notch of said log defines a first groove, and said log is provided with a first spline member having a first portion for being slidably received in said first groove and a second portion defining said first tenon.

15. The corner construction of claim 14 wherein said lower notch defines a second groove and said log is provided with a second spline member having a first portion slidably received in said second groove and a second portion defining said second tenon.

* * * * *